United States Patent [19]

Bos et al.

[11] 3,959,970

[45] June 1, 1976

[54] HYDRAULIC JACK

[75] Inventors: Karel Bos, Brasschaat, Belgium; Hendrik Smit, Pretoria, South Africa

[73] Assignee: Scambia Industrial Developments AG, Liechtenstein

[22] Filed: Apr. 21, 1975

[21] Appl. No.: 569,768

[30] Foreign Application Priority Data

Apr. 25, 1974 Switzerland ..... 5664/74

[52] U.S. Cl. ..... 60/477; 60/481; 60/482; 254/93 H; 29/156.4 R

[51] Int. Cl.[2] ..... F15B 15/18

[58] Field of Search ..... 60/327, 477, 478, 479, 60/480, 481, 482; 254/93 H, 89 H; 29/156.4 R

[56] References Cited

UNITED STATES PATENTS

| | | | |
|---|---|---|---|
| 1,364,865 | 1/1921 | Capell | 60/478 |
| 1,482,256 | 1/1924 | Prall | 60/480 |
| 2,038,974 | 4/1936 | Werner | 60/482 |
| 2,527,428 | 10/1950 | Kemerer | 254/934 |
| 3,782,689 | 1/1974 | Barosko | 60/477 |
| R16,900 | 3/1928 | Dybens | 60/481 |

*Primary Examiner*—Edgar W. Geoghegan
*Attorney, Agent, or Firm*—McGlew and Tuttle

[57] ABSTRACT

The present invention relates to a hydraulic jack with a base plate on which are attached a pump cylinder, a jack cylinder, and a reservoir concentrically surrounding the jack cylinder, the reservoir being connected to the pump cylinder by means of a first passage, passing through the base plate, and a first nonreturn valve which enables hydraulic medium to flow from the reservoir on pumping, the pump cylinder being connected to the jack cylinder by means of a second passage, passing through the base plate, and a second nonreturn valve which enables hydraulic medium to flow from the pump cylinder on pumping, and the jack cylinder being connected to the reservoir by means of a relief passage and a blocking member including an adjustable bolt.

11 Claims, 3 Drawing Figures

HYDRAULIC JACK

FIELD OF THE INVENTION

This invention relates, in general, to hydraulic jacks and, in particular, to hydraulic jacks which are used for lifting vehicles and which often must have dimensions such that they can be transported in a vehicle.

BACKGROUND OF THE PRIOR ART

A proposed vehicle jack has a base plate of steel, on which the jack cylinder and its concentric reservoir are welded. Furthermore this known embodiment has a valve housing connected to the reservoir or the jack cylinder by means of a passage passing through the base plate and being screwed on to the base plate. The pump cylinder is attached on the upper side of the valve housing and, on the inside of the valve housing, there are provided the two nonreturn valves required for the operation of the jack as well as a manually operable blocking member for relieving the jack cylinder. This vehicle jack has the disadvantage that the production of the separate valve housing considerably increases the manufacturing costs. Also, due to the valve housing, the total weight of the jack is increased, which means a considerable disadvantage in the case of jacks which are intended for passenger vehicles.

Furthermore, a jack has been proposed in which the base plate is formed by a cast piece, and in which nonreturn valves and a relief blocking member are provided. Although the nonreturn valves are provided in the cast piece, which has no separate valve housing, almost no material and weight can be saved because the cast piece has an attachment for receiving the relief blocking member in place of the valve housing.

SUMMARY OF THE INVENTION

The present invention aims to provide a vehicle jack in which no separate valve housing is necessary and in which the base plate has a substantially uniform material thickness.

In accordance with the invention, there is provided a hydraulic jack with a base plate on which are attached a pump cylinder, a jack cylinder, and a reservoir concentrically surrounding the jack cylinder, the reservoir being connected to the pump cylinder by means of a first passage, passing through the base plate, and a first nonreturn valve which enables hydraulic medium to flow from the reservoir on pumping, the pump cylinder being connected to the jack cylinder by means of a second passage, passing through the base plate, and a second nonreturn valve which enables hydraulic medium to flow from the pump cylinder on pumping, and the jack cylinder being connected to the reservoir by means of a relief passage and a blocking member including an adjustable bolt, wherein the adjustable bolt is guided in a blocking bore situated in the base plate, which bore has a section formed as blocking seat and which bore, on one side of this seat, has a section which is connected by means of a first communicating bore to the reservoir and on the other side of this seat, has a section which is connected by means of a second communicating bore to the jack cylinder, wherein the blocking bore rises towards the edge of the base plate, and wherein the base plate consists of a rolled material and, in the region of an outer end section of the blocking bore, has an indentation stretching substantially to the outer wall of the reservoir and produced by forming, whereby the rolled material in the region of the indentation is of substantially the same thickness as in the remainder of the base plate.

The invention further relates to a method for producing such a hydraulic jack. In this method an edge section of the base plate is provided with the indentation by plastic deformation.

For an understanding of the principles of the invention, reference is made to the following description of typical embodiments thereof as illustrated in the accompanying drawings.

BRIEF DESCRIPTION OF THE DRAWINGS

The invention will now be described in more detail, by way of example, with reference to an embodiment illustrated in the drawings. In the drawings.

GENERAL DESCRIPTION OF THE PREFERRED EMBODIMENT

Figure 1:
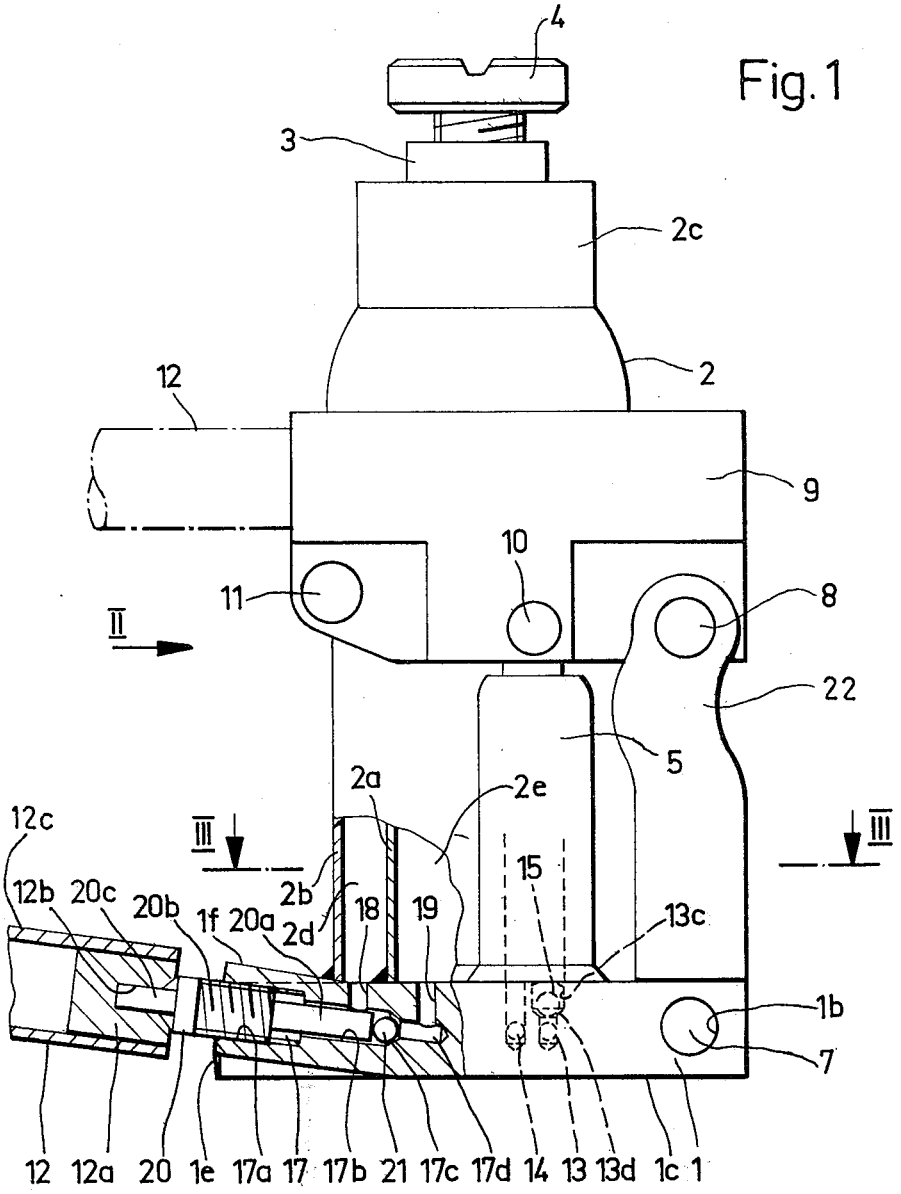
FIG. 1 is a partially, in section, side view of a jack.
Figure 2:
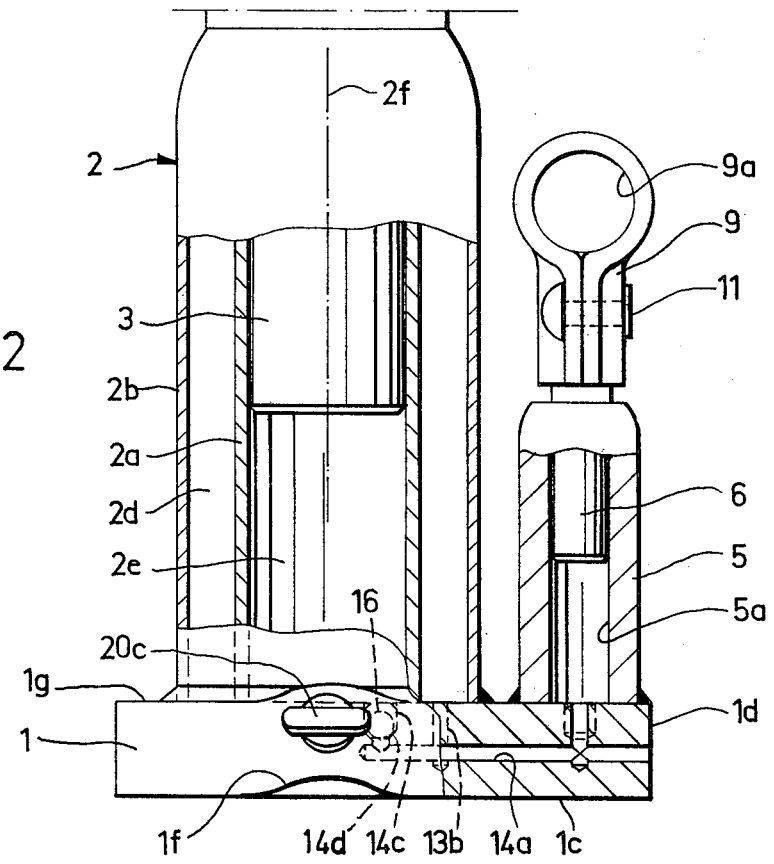
FIG. 2 is a partially, in section, view in the direction shown by arrow II in FIG. 1.
Figure 3:
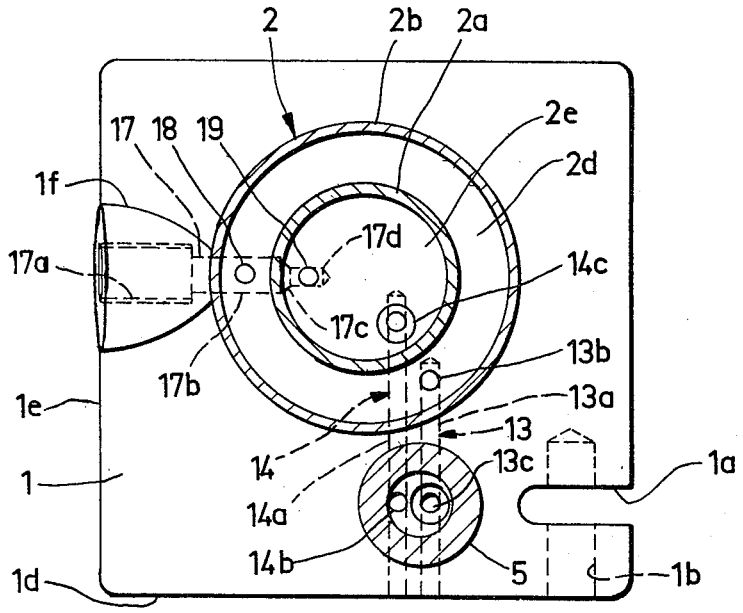
FIG. 3 is a transverse sectional view taken through the jack along the line III—III in FIG. 1, with the movable parts eliminated.

The hydraulic jack illustrated in the drawing has a base plate, 1, on which there is welded a bottle shaped part 2 with two coaxial walls 2*a* and 2*b*. The inner wall 2*a* of the part 2 forms the jack cylinder, which is closed off below by the base plate 1 and in the inner space 2*e* of which the jack piston 3 is guided adjustably. The hollow space limited by the inner wall 2*a* and the outer wall 2*b* and the corresponding section of the base plate 1 forms the reservoir 2*d* for the hydraulic medium. At the upper end 2*c* of the part 2 the jack piston 3 is guided in a bush and the jack cylinder 2*a* is tightly closed off to the outside by means of sealing rings (not shown). The reservoir 2*d* is also closed off to the outside and in the vicinity of its upper end is connected by an overflow opening to the inner space 2*e* of the jack cylinder 2*a*, which opening is not visible in the drawing. A load carrier 4, which is to grip the load to be carried, is adjustably screwed into the upper end of the jack piston 3.

On the base plate 1 there further is welded a pump cylinder 5, in which a pump piston 6 is adjustably guided. The base plate 1 further has a recess 1*a* and a bore 1*b* extending perpendicularly to the recess 1*a* and crossing it. An end of the guide 22, which is connected to the base plate 1 by means of a bolt 7 inserted into the bore 1*b*, extends into the recess 1*a*. A link member 9 is connected to the other end of the guide 22 by means of a bolt 8, and is also connected pivotably to the pump piston 6 by means of a bolt 10. On its end facing away from the bolt 8 the link member 9 is rivetted by means of a rivet 11. The link member 9 further has a bore 9*a*, into which a rod 12, shown in dotted lines in FIG. 1, can be inserted for the operation of the pump piston 6, which rod preferably is hollow so as to save weight.

The hollow space forming the reservoir 2*d* is connected by means of a first passage 13, passing through the base plate 1, and a first non-return valve formed by bevel 13*d* and spherical member 15 to the pump cylinder 5 or, stated more exactly, to its inner space 5*a*. The inner space 5*a* is connected to the jack cylinder 2*a* or, stated more exactly, to its inner space 2*e* by means of a second nonreturn valve 14*d*, 16 and a second passage 14 passing through the base plate 1. The two passages 13 and 14 respectively are each formed by three bores, being a horizontal bore 13*a* or 14*a* parallel to the support surface 1*c* and two vertical bores 13*b*, 13*c* or 14*b*, 14*c* perpendicular to the support surface 1*c*. The horizontal bores, indicated by 13*a* and 14*a*, are bored from side surfaces 1*d* into the base plate 1 and their mouth openings, after production, are welded closed or are closed off by means of a plug. The bore 13*a* of the first passage 13 is connected on the one side by means of the vertical bore 13*b* to the reservoir 2*d* and on the other side by means of second vertical bore 13*c* to the pump cylinder 5. The bore 13*c* has a bevel 13*d* widening upwardly, which serves as valve seat and, together with the spherical member 15 forms the first nonreturn valve 13*d*, 15.

The horizontal bore 14*a* of the second passage 14 on the one hand is connected by the vertical bore 14*b* to the inner space 5*a* of the pump cylinder 5 and on the other hand by means of a second vertical bore 14*c* to the inner space 2*e* of the jack cylinder 2*a*. The vertical bore 14*c* has a bevel 14*d* widening upwardly, which serves as valve seat and together with the spherical member 16 forms the second nonreturn valve 14*d*, 16. As can be seen from the drawing, the two nonreturn valves 13*d*, 15 and 14*d*, 16 are arranged such that the hydraulic medium present in the reservoir 2*d*, on operation of the pump piston 6, can flow from the reservoir 2*d* into the pump cylinder 5 and from here into the jack cylinder 2*a*.

From side surface 1*e* a further bore 17 is drilled into the bore plate 1, which bore is hereafter referred to as the blocking bore. The blocking bore 17 is directed under the region of the base plate covered by the jack cylinder so that its axis intersects the axis 2*f* of the jack cylinder 2*a*. Furthermore the blocking bore 17 extends to below the inner space 2*e* of the jack cylinder 2*a* and rises as it approaches the edge of the base plate 1 or, more exactly, its side surface 1*e*, whereby the angle between the blocking bore 17 and the support surface 1*c* of the base plate 1 is between 5° and 20°. The outermost section 17*a* of the blocking bore 17 is provided with an internal thread, the first narrower section 17*b* is connected by means of a first vertical communicating bore 18, at right angles with the support surface 1*c*, to the reservoir 2*d*. A bevelled section 17*c* follows the section 17*b* and then there follows a second narrower section 17*d*. The latter is connected to the inner space 2*e* of the jack cylinder 2*a* by means of a second vertical communicating bore 19. The bevel 17*c* of the blocking bore is formed as a closing seat and forms, together with the adjustable bolt 20 and the spherical blocking member 21, a blocking means 17*c*, 20, 21. The blocking bore 17 and the communicating bores 18 and 19, together form the relief passage 17, 18, 19. A bolt 20 serving for opening and closing the blocking member 17*c*, 20, 21, at its end facing towards the blocking member 21, has a cylindrical section 20*a*, from which there follows a section 20*b* provided with an outer thread. At its end projecting from the blocking bore 17 the bolt 20 is provided with a wing 20*c*.

In order that a sufficient material thickness is obtained, between the blocking bore 17 and the upper surface 1*g* of the base plate 1, notwithstanding the inclination of the blocking bore 17, the base plate 1 is provided with a wave formation 1*f* in the region of the outer end section 17*a* of the blocking bore 17. This wave formation extends in the direction of the blocking bore 17 to about the outer wall 2*b* of the reservoir 2*d*, so that the upper surface 1*g* of the base plate is flat in the region in which the part 2 is welded on it. Furthermore the wave formation 1*f* should have a width, that is an extension measured transversely to the blocking bore 17 in the region of the side surface 1*e*, which is at least equal to the diameter of the outermost section 17*a* of the blocking bore. Thereby, the material surrounding the blocking bore 17 has a sufficient thickness and rigidity. On the other hand, the width of the wave formation 1*f* should not be unnecessarily large because otherwise the region of the base plate 1 lying on the floor is decreased and thereby the stability of the jack is reduced. The width of the wave formation therefore should, depending on the inclination angle of the blocking bore 17, approximately be equal to two to three times the diameter of the outermost section of the blocking bore. The base plate 1 consists of a rolled material, and preferably of rolled steel. For the production of the base plate this is cut to the intended size. Then the wave formation 1*f* is produced by a pressure-tool by means of cold deformation in the edge section limited by the side surface 1*e*. The wave formation produced in this manner by plastic deformation substantially has the same material thickness as the remainder of the base plate 1. After the formation of the wave formation 1*f*, the different bores are drilled into the base plate, are cleaned and then the mouths of the horizontal bores 13*a* and 14*a* are closed. Subsequently the part 2 and the pump cylinder 5 can be welded, for example by friction welding, to the base plate, and finally the movable elements can be mounted.

For opening and closing the blocking member, advantageously rod 12 which is also used for the pump piston, is used.

The rod 12 formed mainly by a pipe 12*c*, has, at one end, a plug 12*a* inserted into the pipe 12*c*. This is provided with a transverse groove 12*b*, which is of such dimension that the rod 12, as is illustrated in FIG. 1, can be inserted over the wing 20*c* of the adjustable bolt 20, so that the rod 12 is coupled rigidly to the bolt 20 at this position. The plug 12*a*, provided with the groove 12*b*, and the wing 20*c* therefore form a coupling means 12*a*, 12*b*, 20*c* and make it possible to transmit a rotational movement from the rod 12 to the bolt 20. Advantageously the rod ends and the wing 20 are formed such that the rod 12 is centered on application and cannot be radially displaced on rotation. Such coaxial guidance can be obtained, for example, by ensuring that the groove 12*b* extends only up to the inner surface of the pipe wall and that the extent of the wing in radial direction is somewhat smaller than the inner radius of the pipe 12*c*. The rod 12, having a length of about 250 mm up to 500 mm, is preferably provided at its free end, not illustrated in FIG. 1 and facing away from the bolt 20, with an angled section or with a transverse rod, which forms a type of crankpin and facilitates the rotation of the rod 12. The radial extension of this crankpin clearly must be adjusted to the length of the rod 12 and the inclination angle of the bolt 12, so that the crankpin does not touch the floor in any rotational position, on which floor the jack is placed.

The embodiment described above is, in particular, advantageous for jacks which are intended for lifting loads with a weight of up to 5 tons, which are intended for transportation in passenger vehicles. Because nonreturn valves and the relief blocking means are arranged in the base plate, the weight and the manufacturing cost of the jack can be kept relatively low. The inclination of the blocking bore 17 and bolt 20 make it possible for the blocking member to be opened easily for emptying the jack cylinder and lowering the jack piston by means of the rod 12, and bolt 20 and thereafter for closing it again.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

What is claimed is:

1. A hydraulic jack with a base plate, on which are attached a pump cylinder, a jack cylinder, and a reservoir concentrically surrounding the jack cylinder, the reservoir being connected to the pump cylinder by means of a first passage, passing through the base plate, and a first nonreturn valve which enables hydraulic medium to flow from the reservoir on pumping, the pump cylinder being connected to the jack cylinder by means of a second passage, passing through the base plate, and a second nonreturn valve which enables hydraulic medium to flow from the pump cylinder on pumping, and the jack cylinder being connected to the reservoir by means of a relief passage and a blocking member including an adjustable bolt, wherein the adjustable bolt is guided in a blocking bore situated in the base plate, which bore has a section formed as blocking seat and which bore, on one side of this seat, has a section which is connected by means of a first connection bore to the reservoir and on the other side of this seat, has a section which is connected by means of a second connection bore to the jack cylinder, wherein the blocking bore rises towards the edge of the base plate, and wherein the base plate consists of a rolled material and, in the region of an outer end section of the blocking bore, has an indentation stretching substantially to the outer wall of the reservoir and produced by forming, whereby the rolled material in the region of the indentation is of substantially the same thickness as in the remainder of the base plate.

2. Method for producing the hydraulic jack according to claim 1, wherein an edge section of the base plate is provided with the indentation by means of plastic deformation.

3. Method according to claim 2, wherein the indentation is formed by cold deformation.

4. A hydraulic jack, comprising a base plate with a top surface, and at least one edge surface, a jack cylinder attached to said top surface and said base plate, a reservoir concentrically surrounding said jack cylinder and attached to said top surface, a hydraulic medium within said reservoir, a pump cylinder on said top surface, and spaced away from said reservoir, a first passage in said base plate with a first opening at one end of said passage, communicating with said reservoir and having a second opening at the opposite end of said passage, communicating with said pump cylinder, first non-return means in said first passage permitting flow of said hydraulic medium only in a direction toward said pump cylinder, a second passage in said base plate having a first opening communicating with said pump cylinder and having a second opening communicating with said jack cylinder, second non-return means in said second passage, permitting flow of said medium only in a direction towards said jack cylinder, a blocking bore defining a passage in said base plate and opening at its one end in said base plate edge and having first and second connecting passageways extending between said reservoir and said blocking bore passage, and between said jack cylinder and said blocking bore passage, respectively, relief valve means in said blocking bore passage between said first and second connecting passageways, blocking means including a member movable in said blocking bore and engageable with said relief valve means to open said relief valve means and allow the medium to flow from said jack cylinder to said reservoir through said connecting passageways said base plate being of uniform thickness and having an upwardly extending wave formation adjacent said edge of said base plate in the vicinity of said blocking bore and including a portion extending downwardly from said edge in a direction toward said reservoir, said blocking bore being disposed in said wave formation and disposed at an angle to the plane of said top surface.

5. A hydraulic jack, according to claim 4, wherein said blocking bore is partially threaded, said blocking member being complementarily threaded and threadable into said blocking bore.

6. A hydraulic jack, according to claim 4, wherein said angle is from 5° to 20°.

7. A hydraulic jack according to claim 4, wherein said base plate is made of rolled steel.

8. A hydraulic jack, according to claim 4, wherein the blocking bore has an axis intersecting the axis of said jack cylinder.

9. A hydraulic jack according to claim 4, wherein said first passage comprises a vertical bore opening into said reservoir and extending downwardly to a horizontal bore extending toward the pump cylinder, a second vertical bore extending upwardly toward said pump cylinder having a bevelled portion increasing in diameter upwardly from said second vertical bore and a wider bore portion communicating said bevel end portion and said pump cylinder, said bevel end portion and the wider bore forming a valve seat, and a spherical valve member comprising first non-return means engageable on said seat.

10. A hydraulic jack according to claim 4, wherein said second passage comprises a vertical bore opening in said pump cylinder extending downwardly to a horizontal bore extending towards said jack cylinder, a second vertical bore extending upwardly toward said jack cylinder, and having a bevelled portion increasing upwardly from said second vertical bore and a wider bore portion communicating said bevelled portion with said jack cylinder, said bevel portion and said wider bore portion forming a second valve seat and a second spherical member comprising said second non-return means engageable on said second valve seat.

11. A hydraulic jack, comprising a base plate with a top surface, and at least one edge surface, a jack cylinder attached to said top surface and said base plate, a reservoir concentrically surrounding said jack cylinder and attached to said top surface, a hydraulic medium within said reservoir, a pump cylinder on said top surface, and spaced away from said reservoir, a first passage in said base plate with a first opening at one end of said passage, communicating with said reservoir and having a second opening at the opposite end of said passage, communicating with said pump cylinder, first non-return means in said first passage permitting flow of said hydraulic medium only in a direction toward said pump cylinder, a second passage in said base plate having a first opening communicating with said pump cylinder and having a second opening communicating with said jack cylinder, second non-return means in said second passage, permitting flow of said medium only in a direction towards said jack cylinder, a blocking bore defining a passage in said base plate and opening at its one end in said base plate edge and having first and second connecting passageways extending between said reservoir and said blocking bore passage, and between said jack cylinder and said blocking bore passage, respectively, relief vave means in said blocking bore passage between said first and second connecting passageways, blocking means including a member movable in said blocking bore and engageable with said relief valve means to open said relief valve means and allow the medium to flow from said jack cylinder to said reservoir through said connecting passageways, said blocking bore comprising a threaded portion opening on said edge and extending toward said reservoir, a first narrow bore portion extending inwardly from said threaded portion, a blocking bevelled portion decreasing away from said narrow bore portion and a second narrow bore extending from said bevelled portion and ending in said base plate, a first vertical bore communicating said first narrow bore portion with said reservoir and a second vertical bore communicating said second narrower bore with said jack cylinder, a spherical member seated in said first narrower bore and against said blocking bevel end portion, said blocking means being movable against said spherical member to restrain flow of the medium between said reservoir and said jack cylinder.

* * * * *